US005788534A

United States Patent [19]

Koegel et al.

[11] Patent Number: 5,788,534

[45] Date of Patent: Aug. 4, 1998

[54] CONNECTOR WITH INTEGRAL CABLE CLAMP

[75] Inventors: Keith Scott Koegel, Plainfield; Kenneth Wayne Guyer, Thompsontown, both of Pa.

[73] Assignee: The Whitaker Corporation, Wilmington, Del.

[21] Appl. No.: 820,218

[22] Filed: Mar. 18, 1997

[51] Int. Cl.[6] ..... H01R 13/58

[52] U.S. Cl. ..... 439/465; 439/731

[58] Field of Search ..... 439/465, 466, 439/467, 459, 460, 687, 362, 731, 696

[56] References Cited

U.S. PATENT DOCUMENTS

| | | | |
|---|---|---|---|
| 3,349,364 | 10/1967 | Paullus et al. | 339/105 |
| 3,904,265 | 9/1975 | Hollyday et al. | 339/103 M |
| 4,108,527 | 8/1978 | Douty et al. | 339/107 |
| 4,169,648 | 10/1979 | Moist, Jr. | 339/103 R |
| 4,367,005 | 1/1983 | Douty et al. | 339/107 |
| 4,421,376 | 12/1983 | Cosmos et al. | 339/103 M |
| 4,431,249 | 2/1984 | Frantz et al. | 339/107 |
| 4,722,580 | 2/1988 | Kocher et al. | 439/466 |
| 4,762,505 | 8/1988 | Asick et al. | 439/347 |
| 5,123,859 | 6/1992 | Davis et al. | 439/405 |
| 5,162,000 | 11/1992 | Frantz | 439/607 |
| 5,295,859 | 3/1994 | Kawai et al. | 439/466 |
| 5,342,216 | 8/1994 | Davis et al. | 439/362 |
| 5,348,494 | 9/1994 | Falossi et al. | 439/465 |

OTHER PUBLICATIONS

*AMP Catalog 86–784*, "Shielded CHAMP Connectors and Cable Assemblies," Apr., 1987; pp. 1, 12–21, 24; AMP Incorporated, Harrisburg, PA.

*Primary Examiner*—Neil Abrams
*Assistant Examiner*—Tho D. Ta
*Attorney, Agent, or Firm*—Anton P. Ness

[57] ABSTRACT

Assembly (10) for terminating to cable (12) including a pair of covers (40,90) defining a cable exit (20). Channels of the covers at the cable exit have cable-clamping surfaces dimensioned to compress the cable outer jacket upon full assembly The covers include interlocking sections at the cable exit defined by latching arms (62,92) and latch-receiving recesses (72,94). Upon full assembly the latching arms latch in the recesses, and the now-compressed cable presses the latching arms to enhance maintenance of the latched condition.

3 Claims, 3 Drawing Sheets

CONNECTOR WITH INTEGRAL CABLE CLAMP

FIELD OF THE INVENTION

This relates to the field of connectors for termination to conductor cables and more particularly to cable strain relief mechanisms.

BACKGROUND OF THE INVENTION

Connectors such as electrical connectors utilized to terminate electrical cables, commonly are provided with clamping mechanisms that secure to the connector at the cable exit and also clamp onto and around the outer jacket of the cable. Such cable clamps define a strain relief that effects a relief of the terminations of the terminals to the conductors of the cable, from the forces of stress and strain to which the cable is commonly subjected, thus maintaining the integrity of the electrical connections between the terminals and the conductors.

It is desired to provide a cable strain relief that is integral to outer covers of a connector assembly.

SUMMARY OF THE INVENTION

The connector of the present invention provides a pair of covers having opposed channels that together define a cable exit at which are cooperable interlocking sections to both sides of the channel. A first interlocking section to each side of the cable channel is a latching arm protruding from the assembly face of one cover, and a second interlocking section is a latch-receiving recess into the assembly face of the other cover into which the protruding end of the latching arm is received. The recess defines an inwardly facing ledge to which the latching arm latches upon full insertion, when the covers are secured together about the cable end and the housing containing the terminals to which the conductors of the cable have been terminated.

In accordance with the invention, the cable is utilized to secure the latching arm in the recess when the covers have been fully pushed together, by the cable exit being dimensioned to slightly compress the cable jacket upon full cover assembly and transferring the pressure to the interlocking sections in a manner to maintain the latching engagement.

In the preferred embodiment, the latching arm extends tangentially to the cable-clamping surface of the cover with a latch projection facing away from the cable-proximate surface of the latching arm; the latch-receiving recess associated therewith is in communication with the cable-engaging surface and has a ledge facing toward the cable-receiving channel During assembly, the latching arm is first deflected against the cable jacket while the cable remains uncompressed by the covers until passing over the ledge of the latch-receiving recess; then the latch arm resiles to seat in the recess for the latch projection to seat in latching engagement with the latching surface of the ledge, whereafter the now-compressed cable applies pressure to the cable-engaging surface of the latching arm to press the latching arm against the latch to enhance the latched engagement.

Preferably, the covers may have identical cable-clamping regions with a latching arm and a latch-receiving recess disposed on opposed sides of a cable-receiving channel, to correspond with a cover having a like cable-clamping region. The covers may actually be identical and therefore hermaphroditic.

An embodiment of the present invention will now be described by way of example with reference to the accompanying drawings.

DETAILED DESCRIPTION

Figure 1:
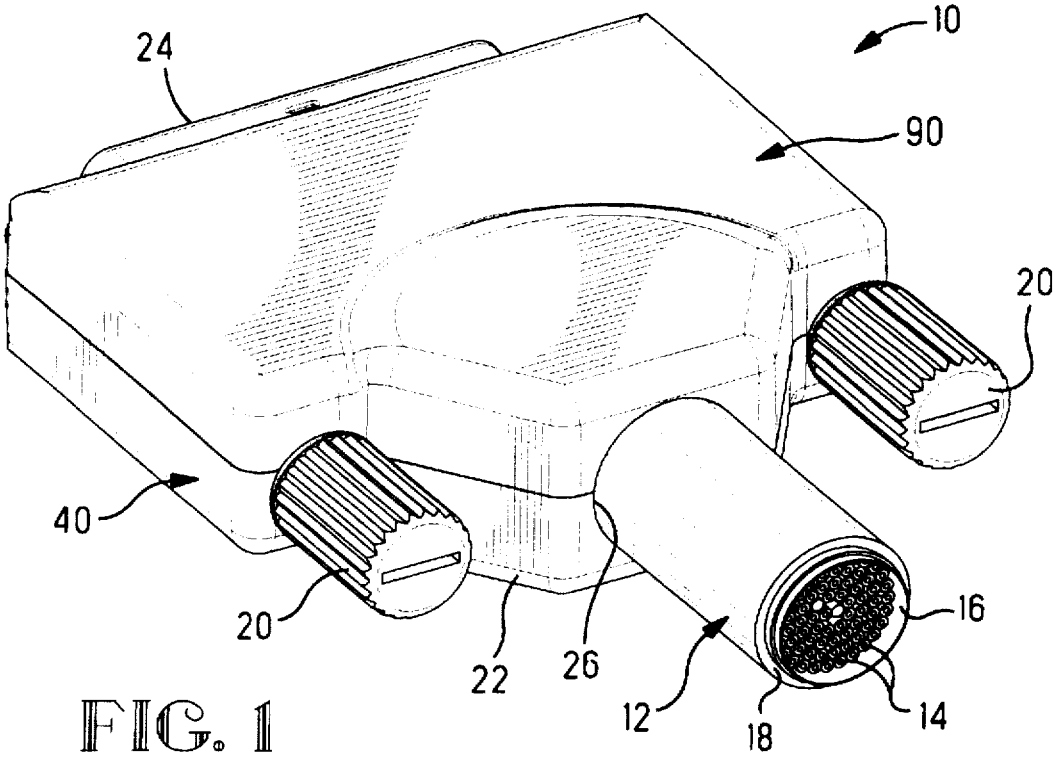
FIG. 1 is an isometric view of an assembly of a cable to a connector having the present invention.
Figure 2:
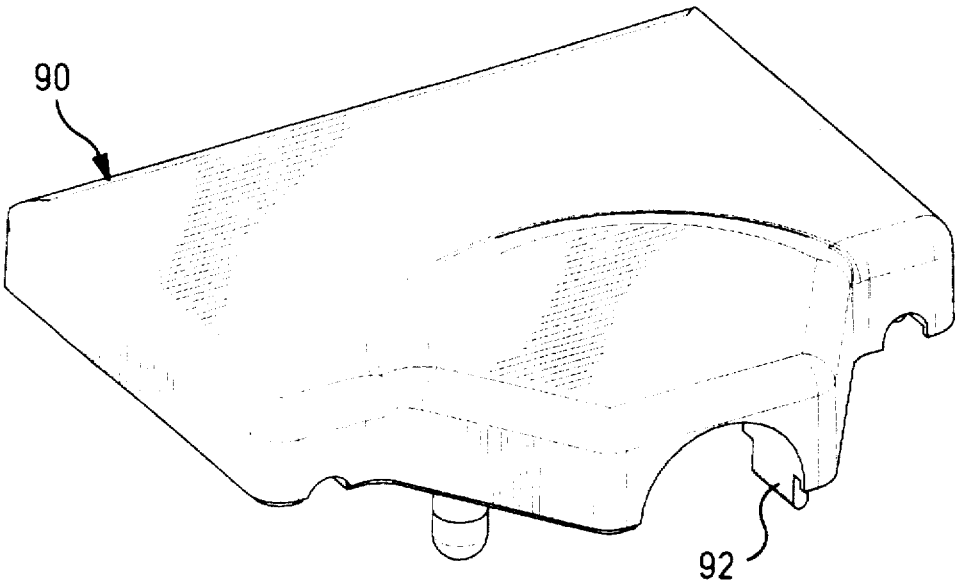
FIG. 2 is an isometric view of the connector of FIG. 1 with the upper cover exploded from the lower cover, and with the cable not shown.
Figure 2:
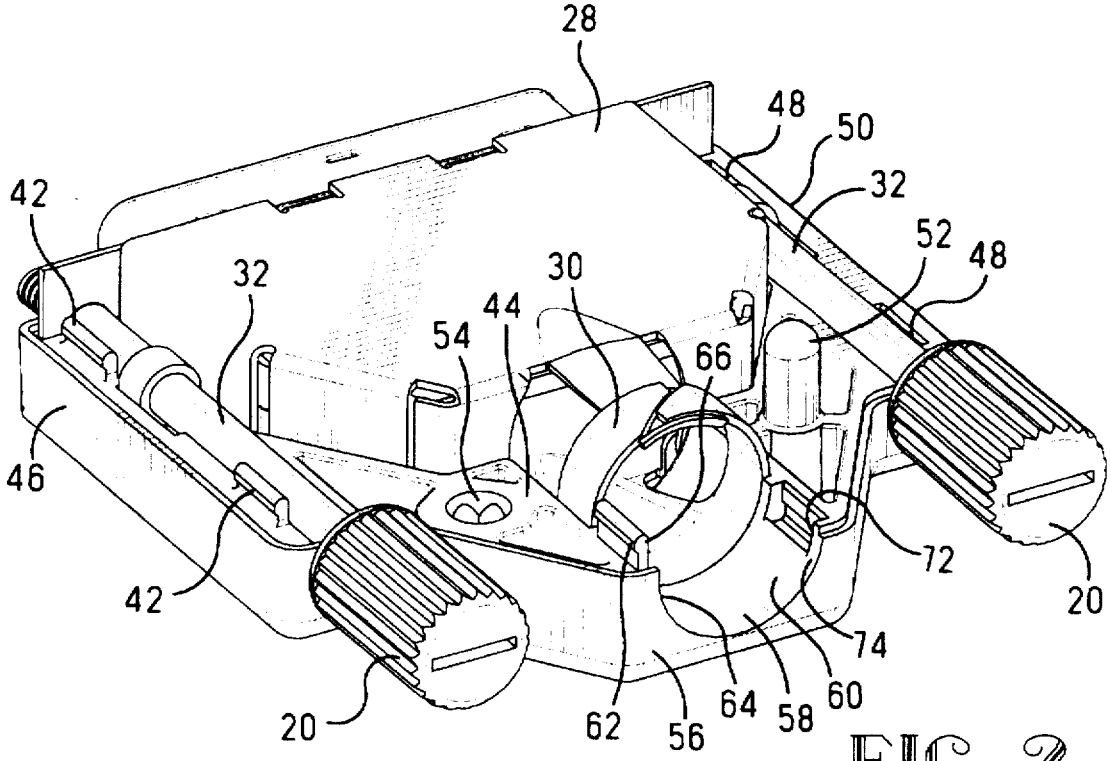

Connector assembly 10 is shown in FIGS. 1 and 2 secured to an end of a cable 12, such as an electrical cable having a plurality of conductors 14 within a shielding braid 16 and an outer jacket 16. Assembly 10 includes an insulative connector housing (not shown) wherein terminals terminated to conductors 14 are housed, and further includes a pair of covers 40,90. Also seen are the actuating sections of a pair of jackscrews 20 extending from rear face 22 defined by the covers, to facilitate mating of connector assembly 10 with a mating connector (not shown) at mating face 24. Cable 12 extends rearwardly from connector assembly 10 through a cable exit 26 along rear face 22. (For purposes of illustrating the invention, the cable is not shown in FIG. 2). As seen in FIG. 2, connector assembly 10 also includes a shield 28 surrounding the insulative housing and including a cable-clamping section 30 securable to and around an exposed length of cable shield 16 to establish a ground connection therewith. Shield 28 is disclosed in greater detail in U.S. patent application Ser. No. 08/820,269 filed Mar. 18, 1997.

Upper and lower covers 40,90 are seen in FIG. 2 to enclose shield 28 when secured to each other, and also enclose the shafts 32 of jackscrews 20 in a manner that allows rotation while limiting the forward and rearward jackscrew movement by trapping a shaft collar in a recess along the shaft-containing channels. Preferably, upper cover 90 is identical with lower cover 40 and is provided with the same structure, with the structure along one side of the assembly face of each cover being complementary to the structure along the other side thereof, symmetrically arranged. Several latch members 42 along the assembly face 44 along one side 46 of lower cover 40, while several latch-receiving recesses 48 are disposed along the other side 50. A post 52 is seen extending from assembly face 44 to one side of cable clamping sections 30 of shield 28, while a post-receiving aperture 54 is disposed at the other side; post 52 is dimensioned to be received in a force-fit into a post-receiving aperture of upper cover 90, and the aperture may be hexagonal in cross-section. The latches and force-fit posts provide for assured self-securing of the covers to each other, and securing at a plurality of locations along the sides.

Figure 3:
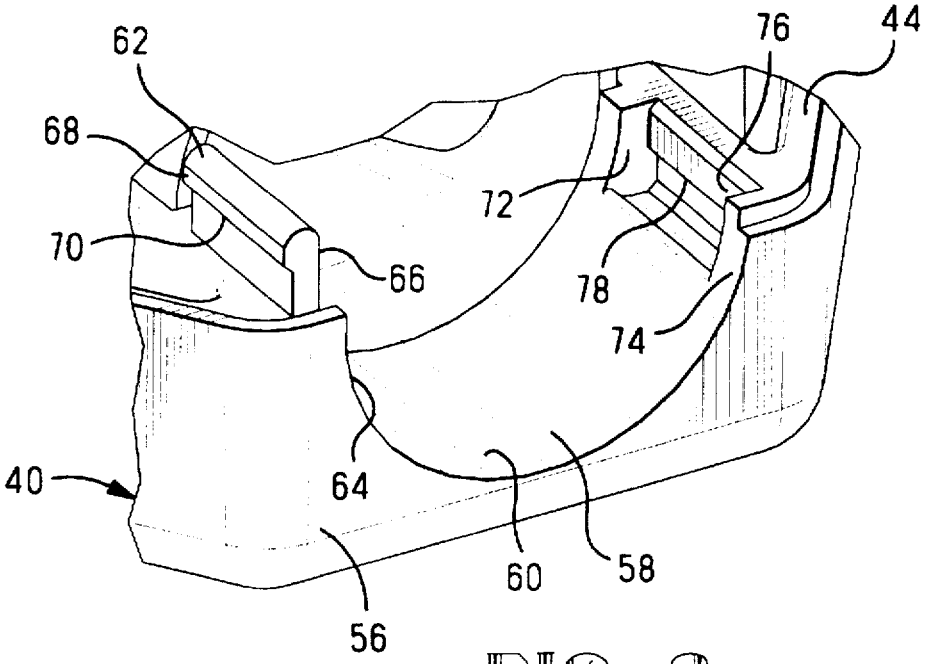
FIG. 3 is enlarged isometric partial view of the cable-clamping region of the lower cover of FIG. 2.

Cable-clamping region 56 is seen in FIGS. 2 and 3 to have a channel 58 defined by a cable-clamping surface 60, semicylindrically shaped. Latching arm 62 protrudes upwardly from assembly face 44 adjacent one side 64 of channel 58, with cable-proximate surface 66 being substantially tangential with cable-clamping surface 60.

Latch projection 68 extends laterally away from channel 58 at the free end of latching arm 62 to define a latching surface 70 substantially facing assembly face 44. A latch-receiving recess 72 is provided adjacent opposite side 74 of channel 58, extending into assembly face 44 and into the cable-clamping surface 60. Recess 72 contains a ledge 76 defining a cooperating latching surface 78 substantially facing in the same direction as latching surface 70 of latch projection 68. Latching arms 42 along the cover sides may be identical to latching arm 62, and likewise latch-receiving recesses 48 may be identical to latch-receiving recess 72 and may be open to the shaft-containing channels. While the latching surfaces 70 and the cooperating latching surfaces 78 are shown as being angled instead of orthogonal as a result of molding requirements, the angled surfaces permit the assembly's several latching engagements to be overcome if the covers were to be intentionally pried apart and opened for repair of the connector therewithin, if desired.

Figure 4:
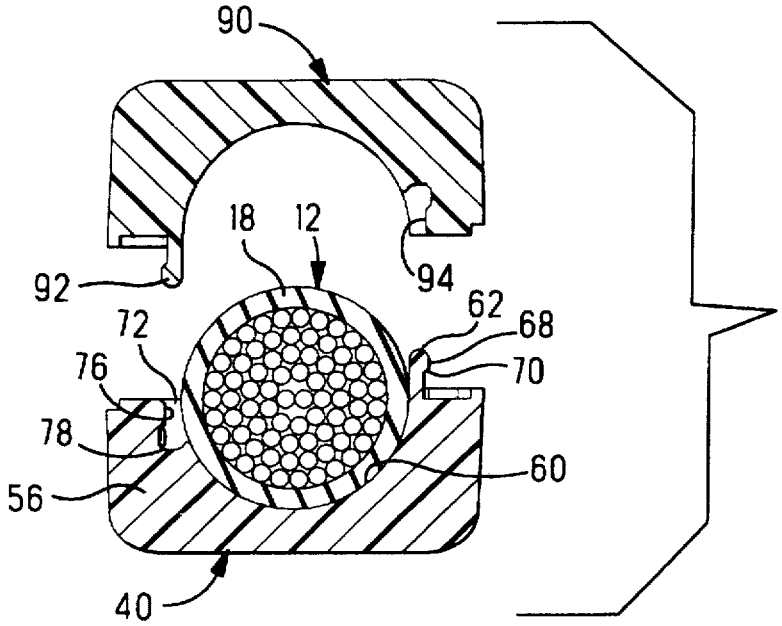
FIGS. 4 to 6 are cross-section views illustrating the cable-clamping regions of the upper and lower covers poised to be clamped about the cable, partially urged together, and fully latched about the cable, respectively.
Figure 5:
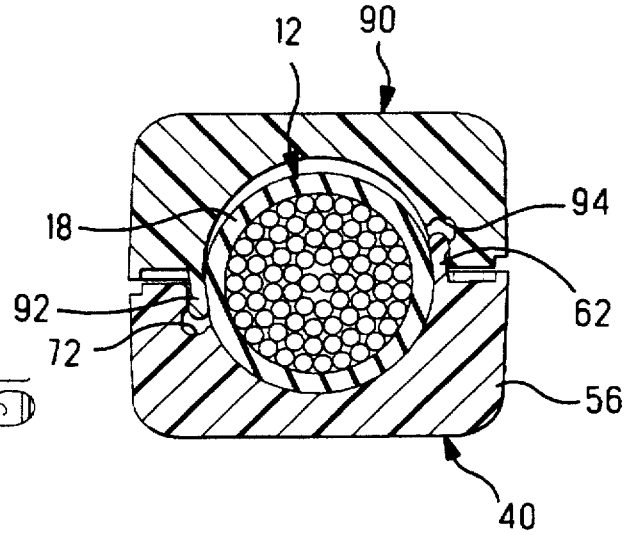
Figure 6:
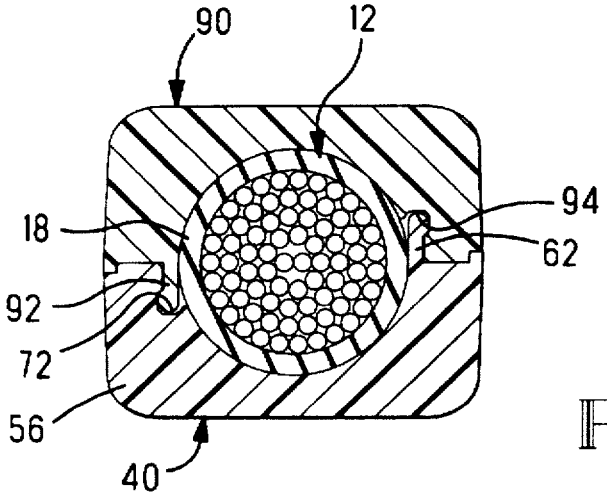

Referring now to FIGS. 4 to 6, cable 12 is illustrated in cross-section disposed within channel 58 of the cable-clamping region of lower cover 40, with latching arm 62 to one side and latch-receiving recess 72 to the opposite side. The cable-clamping region of upper cover 90 is poised in FIG. 4 to be lowered into position atop cable 12, with latching arm 92 opposing recess 72 of lower cover 40, and with latch-receiving recess 94 opposing latching arm 62 of lower cover 40.

In FIG. 5, upper cover 90 has been partially secured to lower cover 40 about cable 12, and cable-clamping surface 96 thereof remains slightly spaced from cable jacket 16 so that the cable is not yet under compression from the cable-clamping surfaces. The latching arms have entered corresponding recesses, and latch projections thereof are bearing against side surfaces of the ledges causing the latching arms to be deflected into the channels and pressing against cable jacket 16. Preferably, the free end of latching arm is angled or rounded to facilitate deflection upon engaging and bearing against the ledge of the latch-receiving recess at the recess entrance.

Finally, in FIG. 6, upper cover 90 has been fully urged against lower cover 40 and latched into position, with the cable-clamping surfaces of both covers cooperating to compress the cable outer jacket held therebetween. Latch projections of the latching arms have seated beneath the ledges of the latch-receiving recesses to latch the covers together at their cable-clamping regions. Cable jacket 16 of cable 12 is under compression and presses laterally outwardly against cable-proximate surfaces of the latching arms, thus enhancing the resistance to delatching of the covers by reason of the cooperating latching arms and latch-receiving recesses at the cable exit.

Variations from the specific embodiment disclosed herein, are possible that are within the spirit of the invention and the scope of the claims. For example, the covers need not be hermaphroditic: one cover could provide both latching arms while the other could provide the latch-receiving recesses. Also a pair of latching arms and corresponding recesses could be provided along each side of the cable-receiving channel.

What is claimed is:

1. A cable-clamping system for a connector assembly terminatable to a cable, comprising:

a pair of covers securable about a connector terminated to a cable end and about an end portion of said cable, said pair of covers defining a cable exit at a rear of the assembly;

each said cover having a cable-clamping region at said cable exit including a cable-receiving channel providing cable-clamping surfaces that together are dimensioned slightly smaller than a diameter of said cable, and each said cable-clamping region including first and second interlocking sections along respective sides of said cable-receiving channel;

one of each of said first and second interlocking sections of at least one of said covers being a latching arm extending from an assembly face to a free end including a latch projection facing away from said channel, and each said latching arm having a cable-proximate surface adjacent the channel; and one of each of said first and second interlocking sections of at least one of said covers being a latch-receiving recess extending into said assembly face and into said cable-clamping surface to a latching ledge, said ledge being cooperable with a said latching arm to latch therewith upon full assembly together of said covers about said connector and said cable end, whereby during urging said covers together about said cable, said latching arms are deflectable into said channels against an outer jacket of said cable, and upon completion of said assembly, said cable is compressed by said cable-clamping surfaces and in turn presses said latching arms outwardly therefrom to enhance maintenance of the latched condition thereof.

2. The cable-clamping system of claim 1 wherein each said cover includes a said latching arm along a first said side of said channel and a said latch-receiving recess along a second said side of said channel, such that said cable-clamping regions of both covers are complementary and identical.

3. The cable-clamping system of claim 2 wherein said covers are identical and hermaphroditic.

* * * * *